United States Patent [19]

Nagashima

[11] Patent Number: 4,901,691

[45] Date of Patent: Feb. 20, 1990

[54] DEVICE FOR MOUNTING INTERNAL COMBUSTION ENGINE ON WORKING MACHINE

[75] Inventor: Akira Nagashima, Kawasaki, Japan

[73] Assignee: Kioritz Corporation, Tokyo, Japan

[21] Appl. No.: 202,250

[22] Filed: Jun. 6, 1988

[30] Foreign Application Priority Data

Jul. 1, 1987 [JP] Japan ..... 62-164786

[51] Int. Cl.[4] ..... F02B 75/06

[52] U.S. Cl. ..... 123/192 R; 248/634; 267/153

[58] Field of Search ..... 123/198 E, 192 R, 192 B; 74/603, 604; 267/153; 180/300; 248/634, 638

[56] References Cited

U.S. PATENT DOCUMENTS

| | | | |
|---|---|---|---|
| 1,578,673 | 3/1926 | Masung et al. | 267/30 |
| 1,638,782 | 8/1927 | Paton | 123/192 R |
| 1,788,878 | 1/1931 | Lee | 123/192 R X |
| 1,828,278 | 10/1931 | Breer | 180/300 |
| 1,834,907 | 12/1931 | Trott | 123/192 R |
| 1,845,803 | 2/1932 | Lee | 123/192 R |
| 4,286,675 | 9/1981 | Tuggle | 173/163 |
| 4,391,041 | 7/1983 | Porter-Bennett | 30/296 R |
| 4,537,275 | 8/1985 | Kimura et al. | 123/192 R |

FOREIGN PATENT DOCUMENTS

| | | | |
|---|---|---|---|
| 1241093 | 5/1967 | Fed. Rep. of Germany . | |
| 734080 | 10/1932 | France | 74/604 |

*Primary Examiner*—Noah P. Kamen

*Attorney, Agent, or Firm*—Browdy and Neimark

[57] ABSTRACT

A device for mounting an internal combustion engine on a machine frame of a working machine includes grooves formed in internal walls of the machine frame so as to oppose each other and to extend in a direction of axis of a crankshaft of the engine, and projections projecting from both lateral sides of a crank case and extending in the axial direction. The projections are fittingly received by the grooves in the internal walls of the machine frame, whereby the internal combustion engine is located in the internal space of the machine frame.

2 Claims, 2 Drawing Sheets

DEVICE FOR MOUNTING INTERNAL COMBUSTION ENGINE ON WORKING MACHINE

BACKGROUND OF THE INVENTION

The present invention relates to a device for mounting an internal combustion engine on a working machine such as a chain saw and a grass trimmer.

In general, a working machine such as a chain saw or a grass trimmer is provided with a machine frame made of a plastic material and mounting an internal combustion engine for driving the machine. A problem is encountered that, since different types of working machines have different construction of the engine mounting device, it is necessary that the mounting structure through which the internal combustion engine is mounted on the frame has to be varied according to the type of the machine, thus restricting the adaptability of the internal combustion engine.

SUMMARY OF THE INVENTION

Accordingly, an object of the present invention is to provide an improved device for mounting an internal combustion engine having a mounting structure through which an internal combustion engine is mounted on the working machine, the mounting structure being simple in construction and, hence, capable of being handled easily, and being standarized so as to be servable for different types of working machines, thereby enabling a standard type internal combustion engine to be mounted on a variety of types of working machines.

To these ends, according to the present invention, there is provided a machine having a machine frame and having formed an internal space, and a combustion engine mounted on said machine frame, characterized by a device for mounting said internal combustion engine on said machine frame comprising:

- a rear opening formed in an axial rear end portion of said machine frame as viewed in the direction of axis of a crankshaft of said internal combustion engine;
- grooves formed in internal walls of said machine frame formed within said internal space, said grooves laterally opposing each other and extending in the direction of said axis of said crankshaft; and
- projections formed on both sides of a crankcase of said internal combustion engine so as to extend laterally from both lateral sides of said crankcase, said projections being disposed and fitted in said grooves, thus locating said internal combustion engine within said internal space.

Thus, the device of the present invention for mounting an internal combustion engine has grooves formed in the inner wall surface of the machine frame and laterally opposing each other in such a manner as to extend in the direction of axis of the crankshaft of the internal combustion engine, while the internal combustion engine to be mounted has projections provided on both sides of the crankcase thereof and extending laterally therefrom in the axial direction. In mounting the engine, the projections are made to fit in the grooves through a rear end opening of the machine frame and are slid along the grooves, whereby the engine can easily be secured to the machine frame. It is thus possible to easily adapt the same internal combustion engine to different types of working machines, whereby the adaptability of the internal combustion engine is increased and the working machine can be produced efficiently.

PREFERRED EMBODIMENT OF THE INVENTION

Figure 1:
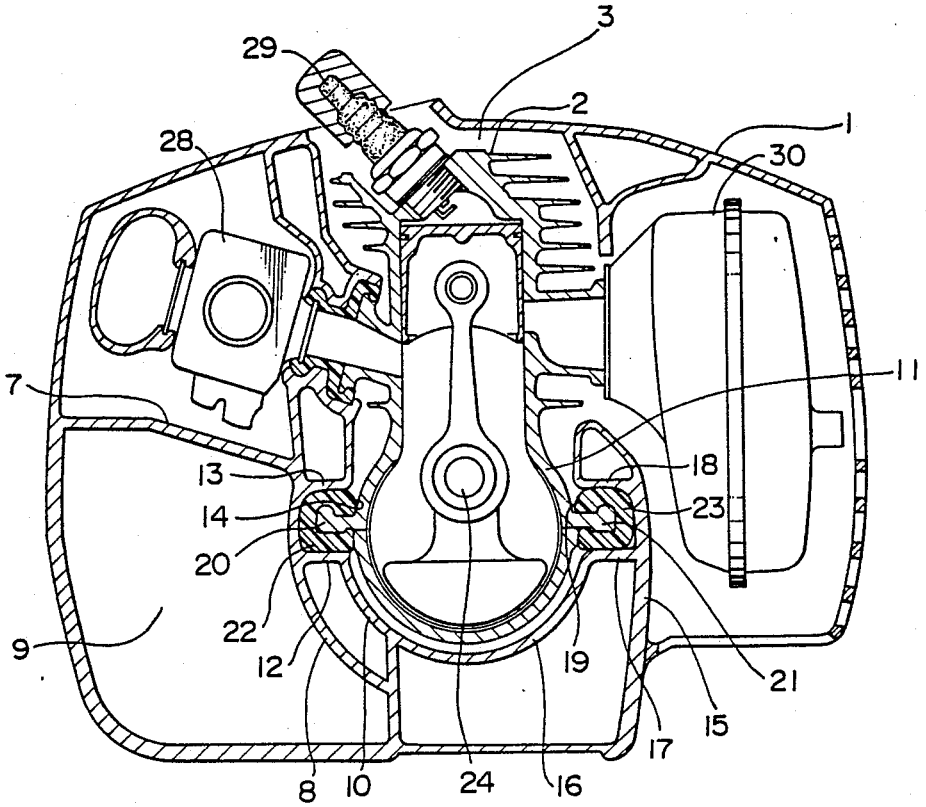
FIG. 1 is a sectional front elevational view of a grass trimmer as a working machine incorporating an embodiment of the engine mounting device in accordance with the present invention.
Figure 2:
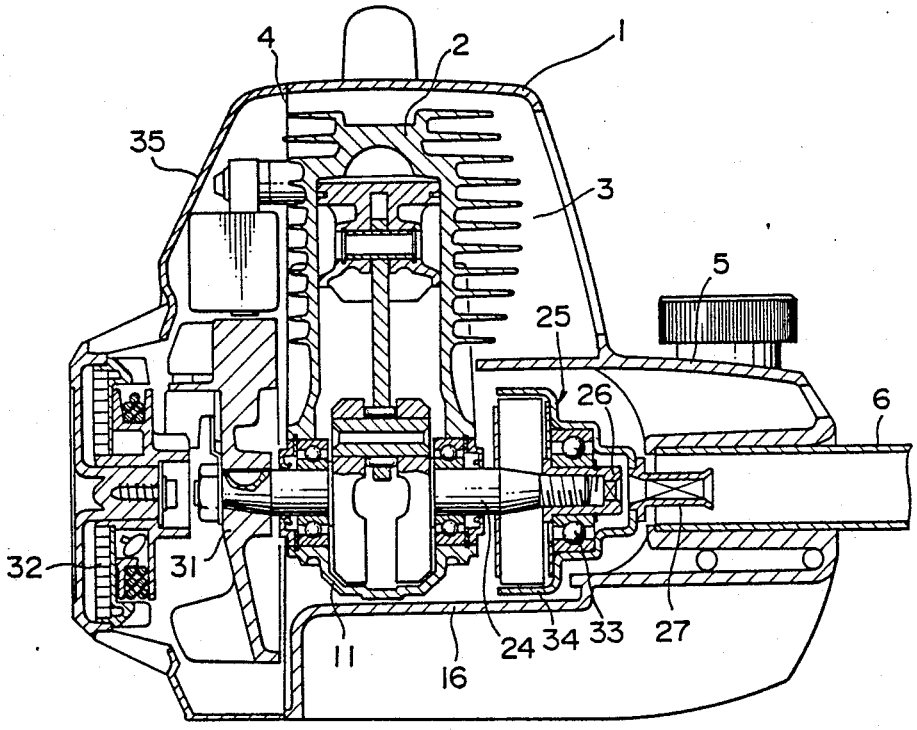
FIG. 2 is a sectional side elevational view of an essential part of the grass trimmer of FIG. 1.

An embodiment of the present invention will be described hereinunder with reference to the accompanying drawings. The attached drawing FIGS. 1 and 2 in combination show a grass trimmer which incorporates the device of the invention for mounting an internal combustion engine. The grass trimmer has a hollow thin-walled machine frame 1 formed from a synthetic resin. As will be explained later, the machine frame 1 defines an internal space 3 for mounting an internal combustion engine 2 and other associated parts. The machine frame 1 is provided at its rear portion as viewed in the direction of axis of the crankshaft 24 with a rear end opening 4 which provides communication between the internal space 3 and the exterior of the machine frame 1. The machine frame 1 is provided at its front portion thereof as viewed in the axial direction with a forward projection 5. A tubular operation rod 6 extends forwardly with its rear end fixed to the projection 5. A cutting blade device which is not shown is disposed on the front end of the operation rod 6. The machine frame 1 is provided with a transverse internal wall portion 7 which extends from one end thereof substantially transversely of the internal space 3, and a curved left vertical internal wall portion 8 which extends upward from the bottom of the machine frame 1 and integrally connected to the transverse internal wall portion 7. The internal wall portions 7 and 8 axially extend through the internal space 3 in the axial direction so as to define a fuel tank portion 9. At the same time, machine frame 1 has a left bracket wall portion 10 which axially extends inwardly of the left vertical internal wall portion 8 and formed integrally therewith. In addition, a left inwardly projecting wall portion 13 is formed above a wall portion 12 on the left upper portion of the left bracket wall portion 10 so as to extend laterally inwardly and so as to extend in the axial direction substantially in parallel with the left upper end wall portion 12. The left upper end wall portion 12 and the left inwardly projecting wall portion 13 cooperate with each other in defining therebetween a left axial groove 14.

Furthermore, the machine frame 1 has a right vertical internal wall portion 15 extending upward from the bottom thereof and positioned to oppose the left vertical internal wall portion 8. The machine frame 1 further has a right bracket wall portion 16 axially extending inwardly of the right internal wall portion 15 and integrally connected to the left bracket wall portion 10. In addition, the right vertical internal wall portion 15 is provided with a right inwardly projecting wall portion 18 above the right upper end wall portion 17 of the right bracket wall portion 16 and axially extending substantially in parallel with the right upper end wall portion 17. The right upper end wall portion 17 and the right inwardly projecting wall portion 18 cooperate with each other in defining therebetween a laterally opening right axial groove 19. The right axial groove 19 opposes the left axial groove 14 mentioned before.

On the other hand, the internal combustion engine 2 is provided with a pair of projections 20 and 21 which project laterally outwardly from both sides of a crankcase 11 thereof and extending in the axial direction. These projections 20 and 21 are received and supported in the grooves 14 and 19, respectively, through an intermediary of suitable elastic cushioning members 22 and 23, whereby the internal combustion engine 2 is disposed in a predetermined position within the internal space 3 of the machine frame 1, in such a manner as to damp vibration of the internal combustion engine.

The crankshaft 24 of the internal combustion engine 2 is disposed in such a manner as to extend from the crankcase 11 axially forwardly towards the front projection 5. A centrifugal clutch device 25 is disposed within the front projection 5 of the machine frame 1. The centrifugal clutch device 25 has a hollow input shaft 26 disposed coaxially with the crankshaft 24 of the internal combustion engine 2 and an output shaft 27 which is supported coaxially with the input shaft 26 and rotatably carried by ball bearings 33 so as to axially extend through the operation rod 6. The output shaft 27 is integral with the clutch drum 34 of the centrifugal clutch device 25. The output shaft 27 is connected to a drive shaft (not shown) which extends forwardly and axially through the operation rod 6. The drive shaft is drivingly connected to a cutting blade (not shown) provided on the end of the operation rod 6, thereby to rotationally drive the cutting blade. In the assembly of the grass trimmer having the described construction, the internal combustion engine 2 having the centrifugal clutch device 25 incorporated therein is inserted into the internal space 3 of the machine frame 1 from the rear end opening 4 and is moved forwardly so that the left and right projections 20 and 21 on the crankcase 11 of the internal combustion engine 2 fit in and slide along the left and right guide grooves 14 and 19 axially forwardly, with the elastic cushioning members 22 and 23 placed between the projections 20 and 21 and the walls of the grooves 14 and 19, whereby the internal combustion engine 2 is disposed at and fixed to a predetermined portion of the machine frame 1. In the drawings, a reference numeral 28 designates a carburetor, while 29 designates a spark plug. Numerals 30 and 31 denote, respectively, an exhaust muffler and a cooling fan which are beforehand mounted on the internal combustion engine 2 mounted in the internal space 3 of the machine frame 1. After the mounting of the internal combustion engine 2, the rear opening 4 of the machine frame 1 is closed by a rear cover 35 to which a recoil starter 32 is secured, whereby the internal combustion engine 2 is held at the predetermined position.

What is claimed is:

1. In a machine having a machine frame and having formed an internal space, and an internal combustion engine mounted on said machine frame, a device for mounting said internal combustion engine on said machine frame comprising:

a rear opening formed in an axial rear end portion of said machine frame as viewed in the direction of axis of a crankshaft of said internal combustion engine;

grooves formed in internal walls of said machine frame formed within said internal space, said grooves laterally opposing each other and extending in the direction of said axis of said crankshaft;

projections formed on both sides of a crankcase of said internal combustion engine so as to extend laterally from both lateral sides of said crankcase, said projections being disposed and fitted in said grooves, thus locating said internal combustion engine within said internal space;

said internal combustion engine insertable into said internal space from said rear opening and movable forwardly with said projections fitted in and slidable along said grooves, a rear cover having a recoil starter secured thereto, said rear cover attached to said machine frame for closing said rear opening and holding said internal combustion engine at a predetermined position on said machine frame whereby said internal combustion engine is disposed at and fixed to a predetermined portion of said machine frame.

2. A device for mounting an internal combustion engine according to claim 1, wherein said projections projecting from both lateral sides of said crankcase fit in said grooves through the intermediary of elastic cushioning members.

* * * * *